US007162941B2

(12) United States Patent
Kovacic et al.

(10) Patent No.: US 7,162,941 B2
(45) Date of Patent: Jan. 16, 2007

(54) UNIVERSAL SLICER WITH POSITIONING PLATE

(75) Inventors: Peter Kovacic, Gomilska (SI); Jozef Skoncnik, Recica (SI)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 0 days.

(21) Appl. No.: 10/928,225

(22) Filed: Aug. 27, 2004

(65) Prior Publication Data

US 2005/0051007 A1 Mar. 10, 2005

Related U.S. Application Data

(63) Continuation of application No. PCT/EP03/01810, filed on Feb. 21, 2003.

(30) Foreign Application Priority Data

Feb. 27, 2002 (DE) ..... 102 08 493

(51) Int. Cl.
*B26D 1/143* (2006.01)
*B26D 7/06* (2006.01)

(52) U.S. Cl. ..... 83/707; 83/438; 83/717; 83/932

(58) Field of Classification Search ..... 83/717, 83/932, 438, 440, 440.1, 441.1, 443, 445, 83/446, 703, 707, 713–716, 718–721, 441, 83/729, 730

See application file for complete search history.

(56) References Cited

U.S. PATENT DOCUMENTS

| | | | | |
|---|---|---|---|---|
| 725,262 | A * | 4/1903 | Lallement | 83/440 |
| 1,756,348 | A * | 4/1930 | Folk | 83/91 |
| 1,860,382 | A | 5/1932 | Campbell | 83/729 |
| 2,004,602 | A * | 6/1935 | Folk | 83/711 |
| 2,136,792 | A * | 11/1938 | Folk | 83/730 |
| 2,177,526 | A * | 10/1939 | Heuer | 83/730 |
| 2,663,341 | A * | 12/1953 | Grove | 83/717 |
| 2,685,315 | A * | 8/1954 | Winberg | 83/717 |
| 2,857,778 | A * | 10/1958 | Rokos | 74/441 |
| 3,124,185 | A * | 3/1964 | Karp | 83/717 X |
| 3,442,312 | A * | 5/1969 | Karp | 83/717 X |
| 6,119,566 | A * | 9/2000 | Yan et al. | 83/717 X |
| 6,209,438 | B1 * | 4/2001 | Mitchell et al. | 83/729 |
| 2002/0069737 | A1 * | 6/2002 | Zhu | 83/91 |

FOREIGN PATENT DOCUMENTS

| | | |
|---|---|---|
| DE | 826 841 | 1/1952 |
| DE | 974 123 | 9/1960 |
| DE | 34 46 656 A1 | 7/1986 |
| GB | 1 469 558 | 4/1977 |

* cited by examiner

*Primary Examiner*—Clark F. Dexter
(74) *Attorney, Agent, or Firm*—Russell W. Warnock; Craig J. Loest

(57) ABSTRACT

A universal slicer contains a housing, a rotatably mounted revolving blade, a positioning plate which is provided with a bearing surface for a product that is to be sliced, and a mechanism regulating the width of cut by adjusting the positioning plate in relation to the revolving blade. In order to ensure that the slices are cut in a uniform manner, particularly when using universal slicers that have a simple configuration and are inexpensive to produce, the universal slicer is provided with a tensioning device, by which the positioning plate can be prestressed free from play counter to the mechanism regulating the width of cut.

19 Claims, 2 Drawing Sheets

UNIVERSAL SLICER WITH POSITIONING PLATE

CROSS-REFERENCE TO RELATED APPLICATION

This application is a continuation, under 35 U.S.C. § 120, of copending international application No. PCT/EP03/01810, filed Feb. 21, 2003, which designated the United States; this application also claims the priority, under 35 U.S.C. § 119, of German patent application No. 102 08 493.9, filed Feb. 27, 2002; the prior applications are herewith incorporated by reference in their entirety.

BACKGROUND OF THE INVENTION

Field of the Invention

The invention relates to a universal slicer having a housing, a rotatably mounted round blade, and a positioning plate which has a bearing surface for an item for slicing. A slicing-width adjustment mechanism is provided for adjusting the positioning plate in relation to the round blade. Universal slicers with a housing and a round blade mounted rotatably therein, up against which an item for slicing bearing against a positioning plate can be brought, are known. The known universal slicers have a plane positioning plate which can be adjusted in relation to the round blade by a slicing-width adjustment mechanism. The position of the positioning plate in relation to the round blade defines the width of the slice of the item for slicing cut off. In general, the slicing-width adjustment mechanism contains a threaded portion which engages in an associated threaded portion on the positioning plate.

It is a disadvantage of the known universal slicers that the positioning plate has relatively great play in relation to the slicing-width adjustment mechanism. Owing to the great play between the positioning plate and the slicing-width adjustment mechanism, the bearing surface of the positioning plate is positioned only roughly. If an item for slicing is placed against the bearing surface of the positioning plate and the item for slicing is moved along the bearing surface toward the round blade, a change in position of the bearing surface of the positioning plate may occur. If a change in position occurs during the slicing operation, slices of varying thickness are produced.

SUMMARY OF THE INVENTION

It is accordingly an object of the invention to provide a universal slicer with a positioning plate which overcomes the above-mentioned disadvantages of the prior art devices of this general type, which produces slices of uniform thickness. The uniformity of the slices is in particular also to be guaranteed in universal slicers that are of a simple configuration and/or inexpensive to manufacture.

With the foregoing and other objects in view there is provided, in accordance with the invention, a universal slicer. The slicer contains a housing, a round blade rotatably mounted in the housing, a positioning plate having a bearing surface for an item for slicing and mounted in the housing, a slicing-width adjustment mechanism for adjusting the positioning plate in relation to the round blade, and a tensioner for prestressing the positioning plate free of play against the slicing-width adjustment mechanism.

By virtue of the tensioning device, by way of which the positioning plate can be prestressed free of play against the slicing-width adjustment mechanism, being provided on the universal slicer, it is ensured that the bearing surface for the item for slicing has a position that no longer changes during the slicing operation. In plastic universal slicers in particular, the positioning plate is adjusted by two mutually engaging threaded portions via a slicing-width adjustment mechanism. The slicing-width adjustment mechanism can comprise a rotatable handle. By rotating the handle, the positioning plate is displaced in relation to the round blade. In order that a clear adjustment travel is achieved on the positioning plate with only a small angular rotation of the handle, the threaded portion on the slicing-width adjustment mechanism is provided with a large thread pitch. The large thread pitch makes it necessary for the mutually engaging threaded portions of the slicing-width adjustment mechanism and of the positioning plate to have relatively great play. Only in this way can the positioning plate be adjusted by the rotatable handle with little effort. In universal slicers of this kind, the disadvantage of mounting the positioning plate with great play proves to be especially great.

In one embodiment of the invention, separate elastic spring elements can be provided inside the housing of the universal slicer, which prestress the positioning plate against the slicing-width adjustment mechanism. Preferably, at least two spring elements are provided, the first ends of which act on the rear side of the positioning plate and the second ends of which are supported against an inner side of the housing. The positioning plate is canted in relation to the slicing-width adjustment mechanism by the elastic spring elements. Owing to the canting, play-free prestressed positioning of the positioning plate is brought about.

In a preferred embodiment of the invention, the positioning plate has a bearing surface which, in proximity to its edge facing the round blade, has at least one raised portion protruding in relation to the remaining bearing surface. In this preferred embodiment, the advantage is obtained that separate elastic spring elements can be dispensed with and prestressing of the positioning plate is nevertheless achieved. This is because when the item for slicing is placed against the bearing surface of the positioning plate, a force acting perpendicularly to the bearing surface is generated by the user. At the beginning of the slicing operation, the user pushes the item for slicing in the direction of the round blade. The item for slicing bearing against the bearing surface of the positioning plate is therefore displaced in the direction of the round blade on the bearing surface. Before the item for slicing reaches the periphery of the round blade, it has to surmount the protruding raised portion in the bearing surface. If the item for slicing is moved against the protruding raised portion, a force is introduced into the positioning plate at the protruding raised portion, which generates a torque that is introduced into the positioning plate and cants or prestresses the latter in relation to the slicing-width adjustment mechanism. In this way, the positioning plate is intentionally moved into a canted position before the item for slicing has reached the periphery of the round blade. For a uniform width of the item for slicing, it is not necessary to align the plane of the bearing surface parallel to the plane of the round blade. For a uniform width of the slice, it is necessary only that that edge of the bearing surface of the positioning plate facing the round blade does not change its spatial position throughout the slicing operation. If the bearing surface of the positioning plate is already prestressed by the protruding raised portion according to the invention at the beginning of the slicing operation, the positioning plate can no longer reposition itself during the slicing operation. It is consequently ensured that that edge of the bearing surface of the positioning plate facing the round blade does not change its position during the slicing operation.

In one embodiment of the invention, the protruding raised portion can be formed by a plurality of raised portions that are distributed uniformly over the entire length of that edge of the bearing surface of the positioning plate facing the round blade. The known positioning plates of plane configuration mainly have a surface structure that prevents the item for slicing bearing against the positioning plate over a large area. The intention of this is that the item for slicing will bear against the positioning plate in only a few surface portions, so that the item for slicing adheres only slightly on the bearing surface of the positioning plate and can easily be moved toward the round blade. If a positioning plate with a surface structure is used in a universal slicer according to the invention, the raised portions according to the invention can be configured correspondingly. If the bearing surface of the positioning plate has, for example, a plurality of horizontally running grooves, the protruding raised portion can then have a corresponding number of horizontally running grooves which are distributed along that edge of the bearing surface facing the round blade and are raised in relation to the plane of the remaining bearing surface. This has the advantage that the item for slicing placed on the surface can be moved toward the round blade with little effort in the region of the protruding raised portions as well.

In a preferred embodiment, the protruding raised portion has a plateau portion which adjoins the edge facing the round blade and has a slope portion which is disposed between the plateau portion and the remaining bearing surface. The plateau portion ensures to a particular degree that the positioning plate is completely prestressed before the item for slicing reaches the periphery of the round blade.

In order to achieve sufficient prestressing effect by the protruding raised portion and at the same time to give the bearing surface of the positioning plate an attractive appearance, the plateau portion can be configuration in such a way that it is raised from the plane of the remaining bearing surface by between 0.5 and 2 mm.

That edge of the bearing surface of the positioning plate facing the round blade has a circular-arc-shaped configuration and the plateau portion can accordingly extend with a constant width along the circular-arc-shaped edge. This ensures that items for slicing of very different cross section or very different size can be processed by the universal slicer according to the invention and the prestressing function is achieved both with items for slicing of very small diameter and with items for slicing of very large diameter. In an advantageous embodiment of the protruding raised portion, the plateau portion has a width of between 10 and 20 mm.

Other features which are considered as characteristic for the invention are set forth in the appended claims.

Although the invention is illustrated and described herein as embodied in a universal slicer with a positioning plate, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
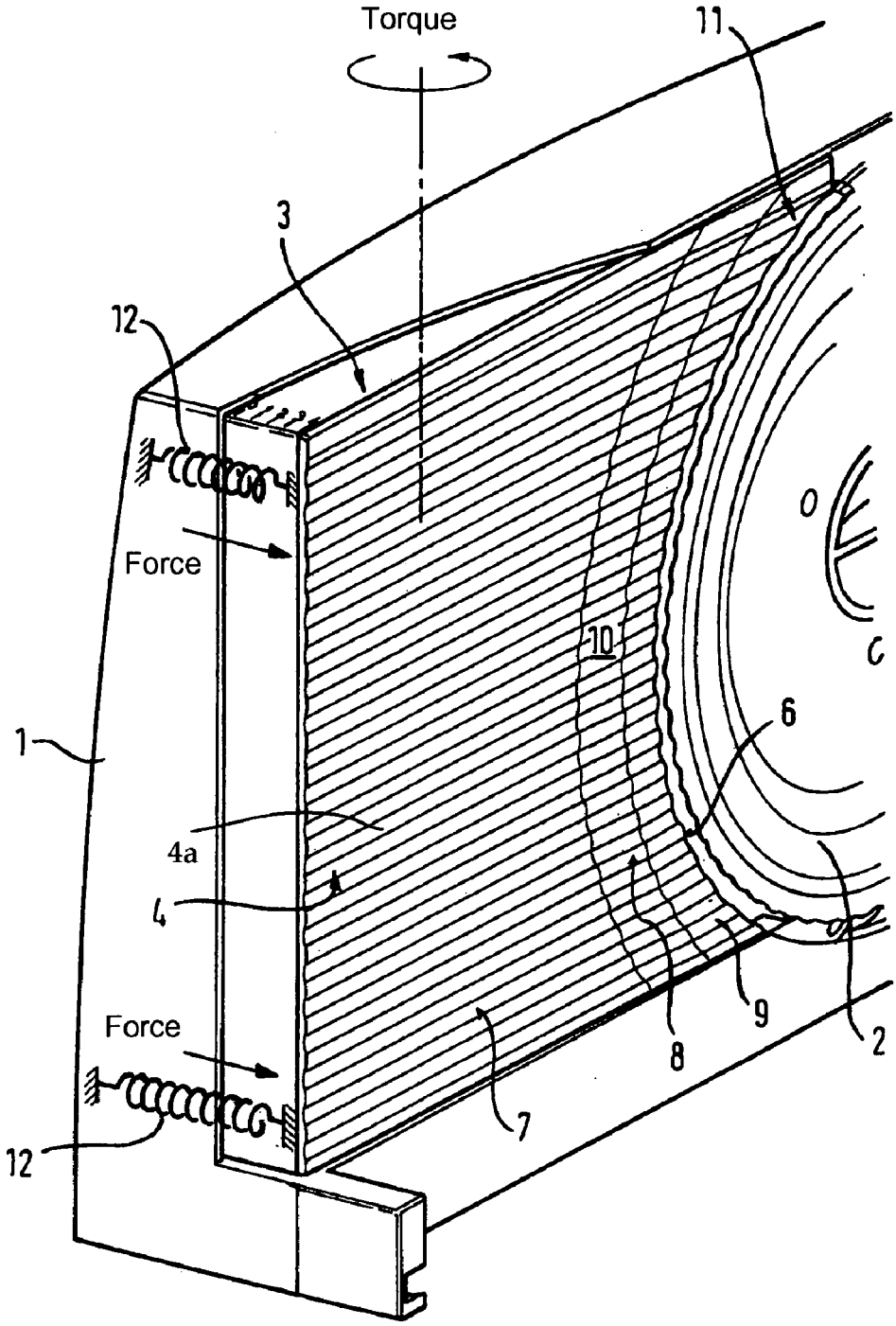
FIG. 1 is a diagrammatic, perspective view of a universal slicer according to the invention.

Referring now to the figures of the drawing in detail and first, particularly, to FIG. 1 thereof, there is shown a universal slicer having a housing 1 in which a round blade 2 is rotatably mounted. The universal slicer has a positioning plate 3 that is mounted adjustably in the housing 1 in relation to the round blade 2. An adjustment of the positioning plate 3 is effected by a slicing-width adjustment mechanism 5 (see FIG. 2). The positioning plate 3 has a bearing surface 4 that has horizontally running grooves 4A. At an edge 6 of the bearing surface 4 facing the round blade 2, a tensioning device 11 in the form of a raised portion 8 extends in a circular-arc shape. The circular-arc-shaped raised portion 8 contains a plateau portion 9 adjoining the edge 6. Disposed between the plateau portion 9 and a remaining bearing surface 7 of the bearing surface 4 is a slope portion 10. The slope portion 10 forms the transition from the surface of the plateau portion 9 to the plane of the remaining bearing surface 7. In a similar way to the horizontally running grooves 4*a* of the remaining bearing surface 7 of the positioning plate 3, both the plateau portion 9 and the slope portion 10 have horizontally running grooves 4*a*. As an alternative configuration of the tensioning device according 11 to the invention, separate tensioning devices 12, which prestress the positioning plate in the housing 1 free of play, can be provided instead of the protruding raised portion 8 formed of the plateau portion 9 and the slope portion 10. In this connection, an elastic tensioning device 12 can in each case act on an edge of the positioning plate 3 opposite the round blade. One end of each elastic tensioning device 12 is then preferably in contact with an inner surface of the positioning plate 3. The second ends of the elastic tensioning device 12 are supported on an inner side of the housing 1.

Figure 2:
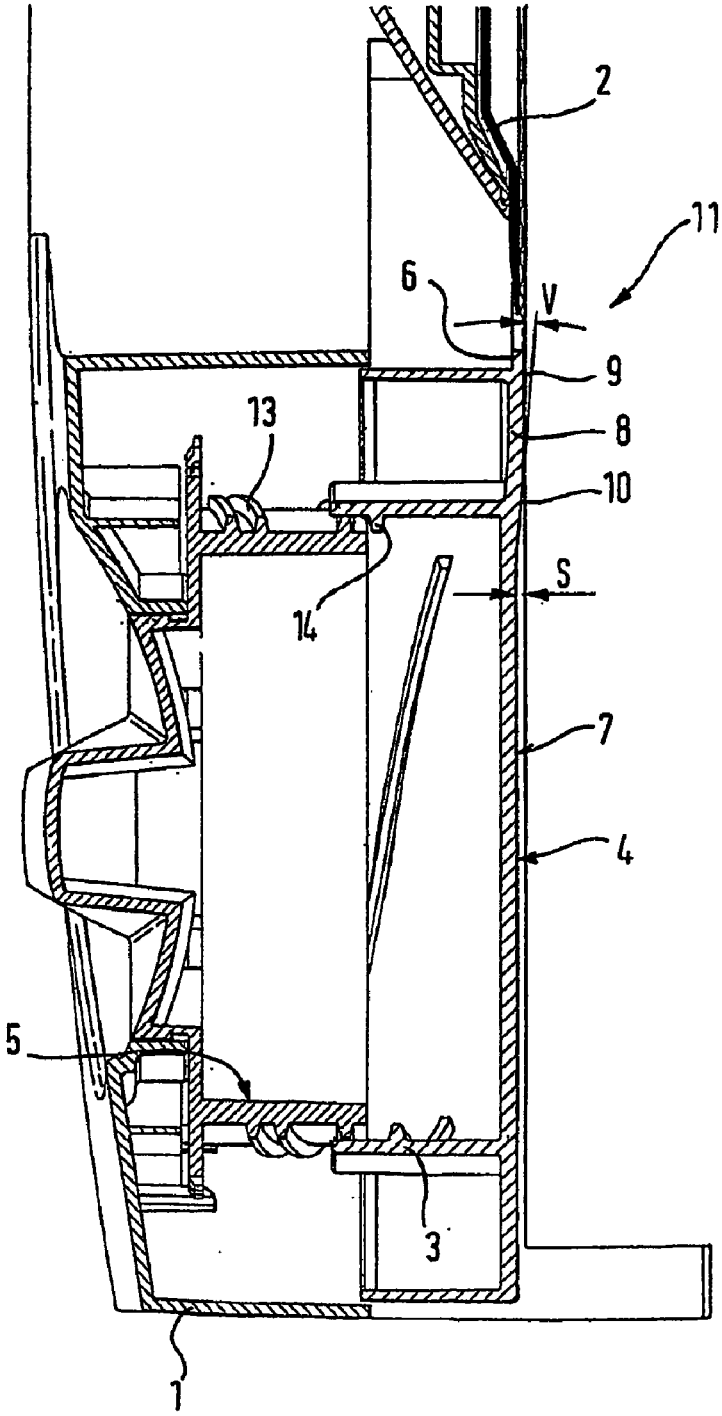
FIG. 2 is a diagrammatic, cross-sectional view through a part of the universal slicer according to the invention according to FIG. 1.

FIG. 2 shows the cross section through a part of the universal slicer according to the invention according to FIG. 1. The slicing-width adjustment mechanism 5 is mounted rotatably in the housing 1. The slicing-width adjustment mechanism 5 has a threaded portion 13 on its side facing the positioning plate 3. The threaded portion 13 is in engagement with a further threaded portion 14 formed on the positioning plate 3. The positioning plate 3 has the bearing surface 4. The bearing surface 4 is disposed on that side of the housing 1 which also bears the round blade 2. The bearing surface 4 has the plateau portion 9 that is raised in relation to the remaining bearing surface 7 by a height S. Located between the plateau portion 9 and the remaining bearing surface 7 is the slope portion 10 which is inclined at an angle V to a plane of the remaining bearing surface 7. The threaded portion 13 of the slicing-width adjustment mechanism 5 and the threaded portion 14 on the positioning plate 3 have as large a diameter as possible, the size of which is adapted to the bearing surface 4 of the positioning plate 3. The protruding raised portion 8, which bears the plateau portion 9 and the slope portion 10, is disposed in a region of the bearing surface 4 which is disposed outside an outside diameter of the threaded portions 13 and 14.

This application claims the priority, under 35 U.S.C. § 119, of German patent application No. 102 08 493.9, filed Feb. 27, 2002; the entire disclosure of the prior application is herewith incorporated by reference.

We claim:

1. A slicer, comprising:

a housing;

a round blade mounted for rotation with respect to the housing;

a positioning plate supported by the housing and having a bearing surface for contacting an item for slicing, the positioning plate having an edge adjacent the round blade, an end disposed opposite the edge, and opposing sides extending between the edge and the end;

a threaded slicing-width adjustment mechanism for adjusting the positioning plate with respect to the round blade; and a tensioner including two compression springs prestressing the positioning plate against the slicing-width adjustment mechanism by biasing the positioning plate in a direction substantially perpendicular to the bearing surface to reduce the amount of free play with the slicing-width adjustment mechanism, wherein the bearing surface comprises a remaining bearing surface forming a majority portion of the bearing surface, and the bearing surface further comprises a raised portion disposed along the edge and protruding outwardly in relation to the remaining bearing surface such that the raised portion and the remaining bearing surface are not co-planar with one another.

2. The slicer according to claim 1, wherein the compression springs are disposed near the end with at least one of the compression springs disposed adjacent each of the opposing sides.

3. The slicer according to claim 1, wherein the slice-width adjustment mechanism includes a handle rotatably mounted on the housing and having a first threaded portion and the positioning plate having a second threaded portion, the first and second threaded portions engaging one another to adjust the location of the positioning plate with respect to the housing in response to rotation of the handle.

4. The slicer according to claim 1, wherein each compression spring has a first end connected to the housing and a second end connected to the positioning plate.

5. The slicer according to claim 1, wherein the raised portion includes a slope portion angling outwardly away from the remaining bearing surface as the bearing surface extends from the end toward the edge.

6. The slicer according to claim 5, wherein the raised portion includes a plateau portion disposed adjacent the edge between the slope portion and the round blade, the plateau portion being substantially parallel with the remaining bearing surface.

7. The slicer according to claim 6, wherein the plateau portion is raised above remaining bearing surface by a distance of about 0.5 to 2 mm.

8. The slicer according to claim 1, wherein the raised portion has an arcuate shape corresponding to an arcuate shape of the edge and extends at a substantially uniform width from the edge as the raised portion extends between the opposing sides of the positioning plate.

9. A slicer, comprising:

a housing;

a round blade mounted for rotation with respect to the housing; and a positioning plate supported by the housing and having a bearing surface for contacting an item for slicing, the bearing surface defining a slicing path along which the item moves toward the blade for slicing, the positioning plate having an arcuate edge adjacent the round blade, an end disposed opposite the edge, opposing sides extending between the edge and the end, and horizontally running grooves recessed from the bearing surface and extending in a direction between the edge and the end, the bearing surface including:

a remaining bearing surface forming a majority portion of the bearing surface; and a raised portion disposed along the edge and in the slicing path, the raised portion protruding outwardly in relation to the remaining bearing surface such that the raised portion and the remaining bearing surface are not co-planar with one another, whereby the item travels over the raised portion prior to contacting the blade.

10. The slicer according to claim 9, wherein the raised portion includes a slope portion angling outwardly away from the remaining bearing surface as the bearing surface extends from the end toward the edge.

11. The slicer according to claim 10, wherein the raised portion includes a plateau portion disposed adjacent the edge between the sloped portion and the round blade, the plateau portion being substantially parallel with the remaining bearing surface.

12. The slicer according to claim 9, wherein the raised portion has an arcuate shape corresponding to the arcuate shape of the edge and extends at a substantially uniform width from the edge as the raised portion extends between the opposing sides of the positioning plate.

13. A slicer, comprising:

a housing;

a round blade mounted for rotation with respect to the housing;

a positioning plate supported by the housing and having a bearing surface for engaging an item for slicing, the bearing surface having an edge adjacent the round blade;

a slice-width adjustment mechanism including a handle rotatably mounted on the housing and having a first threaded portion and the positioning plate having a second threaded portion, the first and second threaded portions engaging one another to adjust the location of the positioning plate with respect to the housing in a direction substantially perpendicular to the bearing surface in response to rotation of the handle;

a means for generating a torque on the positioning plate with respect to the housing, the torque prestressing the positioning plate against the slicing-width adjustment mechanism and reducing the amount of free play between the first and second threaded portions, the bearing surface including a remaining bearing surface forming a majority portion of the bearing surface, and the bearing surface further including a raised portion disposed along the edge and protruding outwardly in relation to the remaining bearing surface such that the raised portion and the remaining bearing surface are not co-planar with one another, the means for generating a torque including the raised portion of the bearing surface.

14. The slicer according to claim 13, wherein the edge adjacent the round blade comprises an arcuate shaped edge.

15. The slicer according to claim 14, wherein the raised portion includes a slope portion angling outwardly away from the remaining bearing surface as the bearing surface extends from the end toward the edge.

16. The slicer according to claim 15, wherein the raised portion includes a plateau portion disposed adjacent the edge between the sloped portion and the round blade, the plateau portion being substantially parallel with the remaining bearing surface.

17. The slicer according to claim 13, wherein the means for generating a torque includes a biasing member coupled to the housing and applying a force on the positioning plate.

18. The slicer according to claim 17, wherein the biasing member includes at least one compression spring.

19. The slicer according to claim 13, further comprising a plurality of horizontally running grooves extending substantially between the edge and the end.

* * * * *